US006212833B1

(12) United States Patent
Henderson

(10) Patent No.: US 6,212,833 B1
(45) Date of Patent: Apr. 10, 2001

(54) TAPERED RIDGE VENT FOR THE PEAK OR RIDGE OF A FRAMED ROOF STRUCTURE

(76) Inventor: John C. Henderson, 335 Summit Rd., Springfield, PA (US) 19008

( * ) Notice: Subject to any disclaimer, the term of this patent is extended or adjusted under 35 U.S.C. 154(b) by 0 days.

(21) Appl. No.: 09/522,189

(22) Filed: Mar. 9, 2000

Related U.S. Application Data

(63) Continuation-in-part of application No. 09/294,404, filed on Apr. 20, 1999.

(51) Int. Cl.[7] ..... F24F 7/00
(52) U.S. Cl. ..... 52/198; 454/365
(58) Field of Search ..... 52/198, 199; 454/365

(56) References Cited

U.S. PATENT DOCUMENTS

| | | | | |
|---|---|---|---|---|
| 5,022,314 | * | 6/1991 | Waggoner | 98/32 |
| 5,095,810 | * | 3/1992 | Robinson | 454/365 |
| 5,167,579 | * | 12/1992 | Rotter | 454/365 |
| 5,651,734 | * | 7/1997 | Morris | 454/365 |
| 5,704,834 | * | 1/1998 | Sells | 454/365 |
| 5,946,868 | * | 9/1999 | Morris | 52/199 |

* cited by examiner

*Primary Examiner*—Carl D. Friedman
*Assistant Examiner*—Steve Varner
(74) *Attorney, Agent, or Firm*—John S. Munday

(57) ABSTRACT

A roof vent device formed from upper and lower outer surfaces sized to define a generally rectangular configuration having a linear axis. A tapered matrix is positioned between the outer surfaces, the taper being directed in a direction perpendicular to the axis to define a thin linear edge and a thick linear edge along the outer edges of the configuration that are parallel to the axis and tapered linear edges along the outer edges of the configuration that are perpendicular to the axis. The tapered matrix has a gap located proximate the middle of the tapered linear edges and extending generally over the linear axis of the outer surfaces. The gap defines an entrance for an air to vent air from beneath the roof ridge out the thick linear edge. The gap further provides a pivot point about which the configuration folds to conform to a roof pitch having a predetermined angle. In one embodiment the matrix is tapered from one outer edge to the gap and the remaining portion of the matrix is generally level. In the preferred embodiment, the taper extends from one linear edge to the other. In a preferred embodiment, a baffle extends out from the thick linear edge and is shaped to deflect outside air away from the thick linear edge without inhibiting air flow out of the linear edge from the air tunnel entrance.

17 Claims, 2 Drawing Sheets

TAPERED RIDGE VENT FOR THE PEAK OR RIDGE OF A FRAMED ROOF STRUCTURE

This is a continuation in part of my copending application having Ser. No. 09/294,404, filed Apr. 20, 1999.

FIELD OF THE INVENTION

This invention relates to a roof vent for permitting hot air to escape from an attic area. More particularly, the invention relates to a tapered roof vent forming part of the roof ridge for providing a vent on one side of the roof line to reduce or substantially eliminate rain, turbulence and wind disturbances from interfering with the venting process.

BACKGROUND OF THE INVENTION

At the present time, roof vents are mounted along the roof ridge to provide a vent from the attic area of a house or other structure, to reduce the build-up of heat in the summer. While venting roofs is a necessary part of house construction, use of auxiliary vents are not cost effective. Specifically, the use of separate exhaust fans and vents adds significant cost to the dwelling and have considerably shorter effective life-spans.

In order to preserve the appearance of the house, the height of the vent is kept at a minimum. For that reason, conventional roof vents are open on both sides of the roof ridge, so that they cooperate with a slit or opening in the roof decking to allow air to vent in both directions. Because of this conventional design, the house roof is exposed to high wind, rain and storms in both directions perpendicular to the length of the roof along the roof ridge. This causes damage to the roof deck, sheathing and tarpaper.

It is estimated that, in the United States, westerly driven winds are associated with 90% of the damaging high winds from storms. Manufacturers of conventional two sided roof vents are forced to protect themselves against damage claims by substantial insurance claims. If a conventional vent were to be used on only one side of the roof ridge line, the opening would have to be so large to be effective that even more damage to the roof deck and perhaps other parts of the attic and roof system. A larger opening would not be facing these westerly winds, of course, but the size itself would still provide undesirable access to the interior of the roof.

It would be of great advantage in the art if a roof vent system could be provided that would eliminate significant exposure to prevailing storm winds and the like, while permitting venting of the attic in a simple, easy to install and attractive manner.

It is therefore an object of this invention to provide an improved roof ridge vent.

Another object is to provide a roof ridge vent device that is easy to install in conventional roof construction, utilizing conventional roof decking construction.

Yet another object of the present invention is to provide a roof ridge vent while eliminating at least half of any lift up to which the roof would conventionally be exposed.

Other objects will appear hereinafter.

SUMMARY OF THE INVENTION

It has now been discovered that the above and other objects of the present invention may be accomplished in the following manner. The unique aspect of this invention is the use of a tapered ridge vent for the peak or ridge of a framed roof structure and the like.

A roof vent device is formed from upper and lower outer surfaces sized to define a generally rectangular configuration having a linear axis. Inside the outer surfaces is a tapered matrix having its taper directed perpendicularly to the axis. The device thus has a thin linear edge and a thick linear edge along the outer edges of the configuration and parallel to the axis. It also has tapered linear edges along the outer edges of the configuration perpendicular to that axis.

The tapered matrix includes a gap or opening at the middle of the tapered linear edges that extends over the linear axis of the outer surfaces. The gap serves as an entrance for an air tunnel to the vent in a roof ridge to vent air from beneath the roof ridge. The gap also defines a pivot point about which the configuration can be folded to conform to a roof having any roof pitch. In a preferred embodiment, a baffle is formed by extending the lower outer surface out from the thick linear edge. The baffle may be of various shapes, and is used to deflect outside air coming at the tunnel without inhibiting air flow out of the air tunnel entrance.

The lower surface is attached to the tarpaper on the roof deck, and shingles are placed over the upper outer surface. For that reason, the outer surfaces do not need to be impermeable. The shingles and tarpaper preserve the integrity of the structure as intended.

The preferred material for the matrix is polymeric wire, such as stiff nylon wire, formed into a passage capable of supporting the outer surfaces. When the matrix is defined by wire, a passage capable of supporting the outer surfaces is provided. Preferred geometry for the matrix is a plurality of decreasingly tall geometric shapes having a larger base attached to the lower outer surface and small top attached to the upper outer surface. Pyramids, cones and other less conventional shapes may be used, as long as substantially more than half of the space between the upper and lower surfaces is open.

BRIEF DESCRIPTION OF THE DRAWINGS

For a more complete understanding of the invention, reference is hereby made to the drawings, in which.

DETAILED DESCRIPTION OF THE PREFERRED EMBODIMENT

Figure 1:
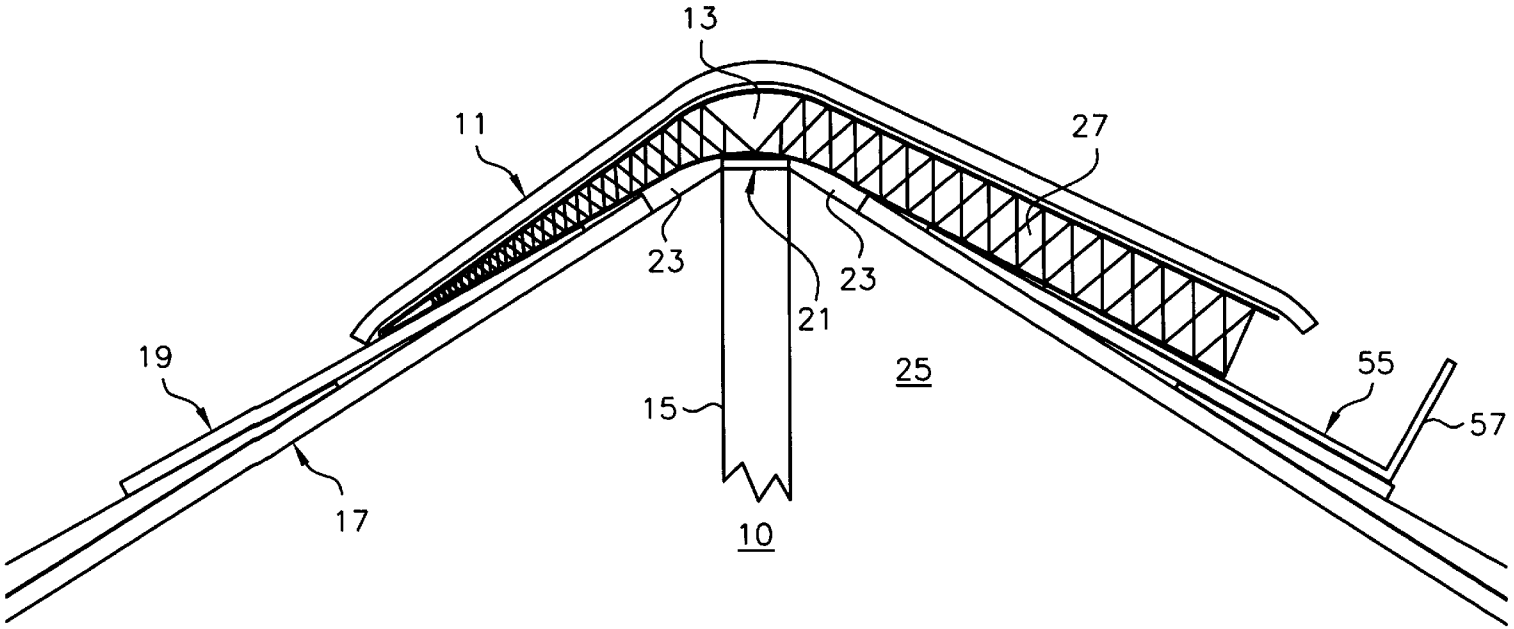
FIG. 1 is a cross sectional view of a roof ridge illustrating placement of the device of the present invention.

The present invention is useful for most forms of roofing that have a peak along an axial direction. For purposes of illustration, the present invention is shown on a shingle roof, but is not limited to this embodiment. As seen in FIG. 1, the typical roof ridge is shown 10, generally, as having an asphalt shingle ridge capping 11 along the entire length of the roof, so as to define an axis 13. A structural ridge board 15 is part of the attic rafter system for many roof designs. The roof is built on a rafter system on which roof decking 17 or sheathing with tarpaper, on top of which are the shingles 19. In most roof ridge assemblies, a small (e.g., 1.5 inches, more or less) piece of roof decking 21 is added to fill the void atop the ridge board 15, and a small (e.g., 1 inches, more or less) slit 23 in the roof decking 17 is provided to permit air to escape the attic 25, generally along the entire length of the roof ridge axis 13.

Under shingles 19 and on top of roof decking 17 is the device of this invention 27, which provides for a substantially improved vent for relieving heat buildup in attics. The device 27, shown in cross section in FIGS. 2 and 3 and in perspective view in FIG. 4, includes an upper and lower surfaces, 29 and 31 respectively, which are sized to define a generally rectangular shape or configuration 33, as seen in FIG. 4. Configuration 33 is shown as being rectangular, and examples have been fabricated with a length of 48 inches and a width of 11.5 inches. Other dimensions are also suitable, as would be expected. Upper and lower surfaces 29 and 31 may be made from any durable substance, such as fiberglass, woven polymers such as polyamides (nylon), polyesters and the like. The function of the upper and lower surfaces is to hold the device 27 together and provide a base for mounting the internal portion therein. Any material that is capable of surviving long periods of time in the roof ridge environment can be used.

Figure 2:
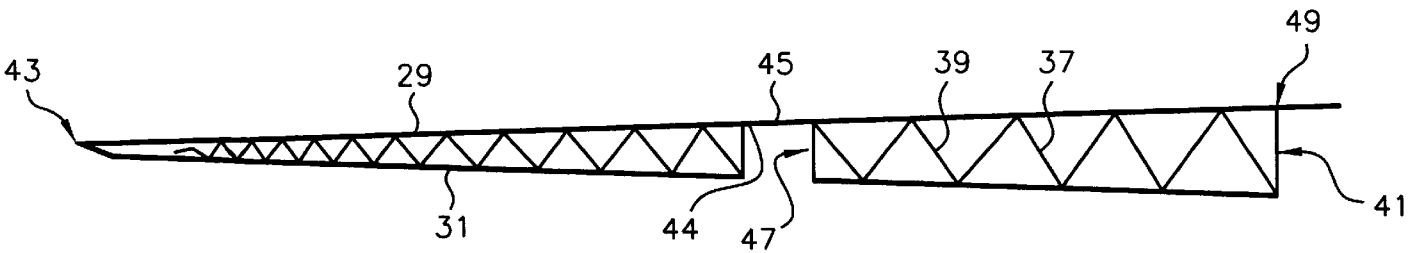
FIG. 2 is an enlarged cross sectional view of the design of the vent device used in the roof ridge of FIG. 1 prior to bending.
Figure 3:
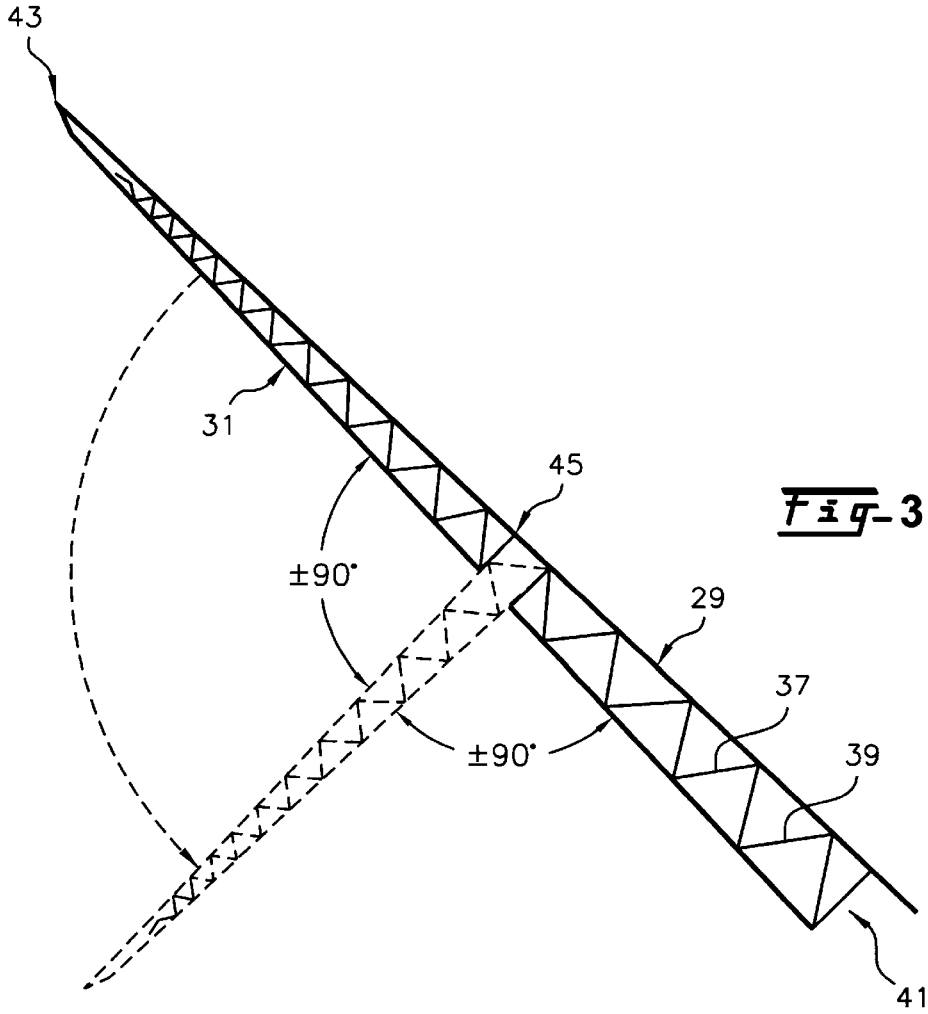
FIG. 3 is a cross sectional view of a portion of the vent device of FIG. 2, after bending to conform to a roof ridge.
Figure 4:
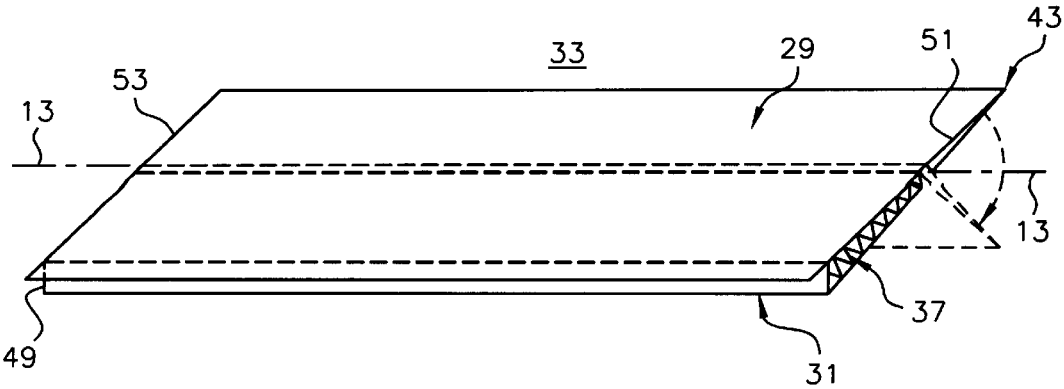
FIG. 4 is a perspective view of a portion of the ridge vent device of the invention shown in FIGS. 1–3.

A matrix 37 is positioned between upper surface 29 and lower surface 31 as shown in FIGS. 2 and 3. Matrix 37 is made from any material that can function over long periods of time in a roof ridge environment without deteriorating. Polyamide wire is the preferred material because it can be formed into a woven mesh having a desired shape by relatively simple and economic methods. Other materials are also suitable and are known in the trade as being capable of "weathering" suitably. One commercially available product having a matrix with the properties needed for the present invention is known as a SmartVent ventilation product used from ridge and sofit venting, available frm DCI Products, Inc, in Clifton Heights, Pa.

In addition to resistance to deterioration, however, the matrix must be capable of maintaining its shape after installation in a roof ridge, as described below. For that reason, it is preferred that the matrix be formed from a material that is sufficiently flexible to be woven into shape but strong enough to resist being flattened by the weight of the shingles. One preferred embodiment is to construct the matrix 37 into a series of geometric shapes 39 having a large cross section attached to the lower outer surface 31 and a small cross section attached to the upper outer surface 29. Matrix 37 in FIG. 2, for example, shows a cross section shaped like a triangle, as the individual components 39 of matrix 37 are cone shaped, pyramidal or three-dimensional triangles. The rows of geometric shapes 39 are spaced to provide a maximized open tunnel 41 between shapes 39.

The matrix 37 is also tapered, at least partially and preferably totally from a thin (e.g. 0.125 inches, more or less) linear edge 43 parallel to axis 13 to at least the midpoint 45 of matrix 37 which is to be positioned proximate slit 23 when installed. At midpoint 45, the matrix 37 is generally flat 44 against upper outer surface 29 to permit air to flow into air tunnel 41 via opening 47, as best seen in FIG. 2. In the preferred embodiment, matrix 37 continues to taper in an increasing cross section from midpoint 45 (e.g., 0.5 inches, more or less) to a thick (e.g. 0.75 inches, more or less) linear edge 49 which is also parallel to axis 13. It is also possible to construct a matrix that is not tapered from opening 47 to edge 49, but the full taper is preferred. Configuration 33 thus has two edges 51 and 53 that are perpendicular to axis 13 and which both have a tapered cross section, seen in FIG. 4, for example.

Midpoint 45 also provides for easy installation of the present invention since there is no resisting matrix at midpoint 45 but rather the flattened portion 44. Midpoint 45 defines a pivot point about which the configuration folds to conform to a roof pitch having a predetermined angle. The angle is determined by the construction of the roof and may be anywhere from less than 45°, to 90° as shown in FIG. 3, to more than 135°. In any configuration, the device of this invention functions effectively to provide a superior attic vent.

Since the present invention has a sealed end at thin linear edge 43, weather coming at the roof from that direction does not enter the roof ridge at all. To prevent intrusion of rain and wind into the attic, in a flow counter to the venting function via air tunnel 41, it is preferred, but not essential, to extend lower surface 31 out from the opening at thick linear edge 49 by a small distance 55 (e.g., 2 inches, more or less) along the roof deck 17, then upward for a distance (e.g., 1 inches, more or less) sufficient to serve as a baffle 57, as seen in FIG. 1. Baffle 57 normally is perpendicular to roof deck 17, but other angles are also contemplated by this invention. Thus, even when the location of the house provides for the west side of the house to face away from the street, and thus esthetically require the larger edge to face away from view, prevailing winds to not easily enter air tunnel 41 because of the protective function of baffle 57.

While particular embodiments of the present invention have been illustrated and described, it is not intended to limit the invention to any specific embodiment. The dimensions and materials given are for the preferred embodiment and are not to be construed as limitations on the scope of this invention. The description of the invention is not intended to limit the invention, except as defined by the following claims.

What is claimed is:

1. A roof vent device for use with a roof having a roof ridge vent, comprising:

upper and lower outer surfaces, said surfaces being sized to define a generally rectangular configuration having a linear axis and linear edges;

a matrix positioned between said outer surfaces, said matrix having a gap located proximate the middle of the linear edges parallel to said axis and extending generally over said linear axis of said outer surfaces, said gap defining an entrance for an air tunnel for access to said vent in said roof ridge for venting air from beneath said roof ridge to said thick linear edge; said gap further defining a pivot point about which said configuration folds to conform to a roof pitch having a predetermined angle; and said matrix further being tapered in a direction perpendicular to said axis to define a thin linear edge along the one outer edge of said configuration parallel to said axis, said taper increasing at least to said gap, said matrix further defining a thick linear edge along the other outer edge of said configuration perpendicular to said axis are tapered along said tapered half.

2. The device of claim 1, wherein said matrix is further tapered from said gap to said other outer edge of said configuration perpendicular to said axis.

3. The device of claim 1, wherein said matrix is defined by non-metallic wire woven to produce a passage capable of supporting the outer surfaces.

4. The device of claim 3, wherein matrix comprises a plurality of decreasingly tall geometric shapes having a larger base attached to the lower outer surface and small top attached to the upper outer surface.

5. The device of claim 4, wherein said geometric shapes are selected from cones, pyramids, and three-dimensional triangles.

6. The device of claim 1, which further includes a baffle formed from an extension of said lower outer surface extending out from said thick linear edge and shaped to deflect outside air away from said thick linear edge without inhibiting air flow out of said linear edge from said air tunnel entrance.

7. The device of claim 6, wherein said baffle extends parallel to said lower outer surface to a junction where the baffle is turned to extend upward generally perpendicular to said outer surface.

8. A roof vent device for use with a roof having a roof ridge vent, comprising:

upper and lower outer surfaces, said surfaces being sized to define a generally rectangular configuration having a linear axis;

a tapered matrix positioned between said outer surfaces, said taper being directed in a direction perpendicular to said axis to define a thin linear edge and a thick linear edge along the outer edges of said configuration that are parallel to said axis and tapered linear edges along the outer edges of said configuration that are perpendicular to said axis; said tapered matrix having a gap located proximate the middle of said tapered linear edges and extending generally over said linear axis of said outer surfaces, said gap defining an entrance for an air tunnel for access to a vent in a roof ridge for venting air from beneath said roof ridge to said thick linear edge; said gap further defining a pivot point about which said configuration folds to conform to a roof pitch having a predetermined angle; and a baffle formed from an extension of said lower outer surface extending out from said thick linear edge and shaped to deflect outside air away from said thick linear edge without inhibiting air flow out of said linear edge from said air tunnel entrance.

9. The device of claim 8, wherein said matrix is defined by non-metallic wire woven to produce a passage capable of supporting the outer surfaces.

10. The device of claim 9, wherein said matrix comprises a plurality of decreasingly tall geometric shapes having a larger base attached to the lower outer surface and small top attached to the upper outer surface.

11. A method of venting a roof having a roof peak having a vent, comprising the steps of:

forming a roof vent device having upper and lower outer surfaces, said surfaces being sized to define a generally rectangular configuration having a linear axis;

positioning a tapered matrix between said outer surfaces, said taper being directed in a direction perpendicular to said axis to define a thin linear edge and a thick linear edge along the outer edges of said configuration that are parallel to said axis and tapered linear edges along the outer edges of said configuration that are perpendicular to said axis;

locating a gap in said tapered matrix proximate the middle of said tapered linear edges and extending generally over said linear axis of said outer surfaces, said gap defining an air tunnel entrance;

forming a baffle by extending said lower outer surface out from said thick linear edge, said baffle being shaped to deflect outside air away from said thick linear edge without inhibiting air flow out of said linear edge from said air tunnel entrance;

placing said configuration on a roof peak in a position to access said vent in said roof ridge to vent air from beneath said roof ridge to said thick linear edge;

folding said configuration at said gap, said gap defining a pivot point about which said configuration folds to conform to a roof pitch having a predetermined angle; and bonding said configuration to said roof peak and covering said configuration with shingles.

12. The method of claim 11, which further including the step of defining said matrix by non-metallic wire woven to produce a passage capable of supporting the outer surfaces.

13. The method of claim 12, which further includes the step of forming said matrix from a plurality of decreasingly tall geometric shapes having a larger base attached to the lower outer surface and small top attached to the upper outer surface.

14. The method of claim 13 which further includes the step of forming said geometric shapes from the group consisting of cones, pyramids, and three-dimensional triangles.

15. A roof vent device, comprising:

upper and lower outer surface means for defining a configuration, said surface means being sized to define a generally rectangular configuration having a linear axis; and matrix means positioned between said outer surfaces, said taper being directed in a direction perpendicular to said axis to define a thin linear edge and a thick linear edge along the outer edges of said configuration that are parallel to said axis and tapered linear edges along the outer edges of said configuration that are perpendicular to said axis;

said tapered matrix having a gap located proximate the middle of said tapered linear edges and extending generally over said linear axis of said outer surfaces, said gap defining an entrance for an air tunnel for access to a vent in a roof ridge for venting air from beneath said roof ridge to said thick linear edge; said gap further defining a pivot point about which said configuration folds to conform to a roof pitch having a predetermined angle.

16. The device of claim 15, wherein said matrix means is defined by non-metallic wire woven to produce passage means capable of supporting said outer surfaces.

17. The device of claim 15, which further includes baffle means formed from an extension of said lower outer surface extending out from said thick linear edge and shaped to deflect outside air away from said thick linear edge without inhibiting air flow out of said linear edge from said air tunnel entrance.

* * * * *

UNITED STATES PATENT AND TRADEMARK OFFICE

CERTIFICATE OF CORRECTION

PATENT NO. : 6,212,833 B1
DATED : April 10, 2001
INVENTOR(S) : John C. Henderson It is certified that error appears in the above-identified patent and that said Letters Patent is hereby corrected as shown below:

Title page,
Item [60], Related U.S. Application Data, should read -- Provisional application No. 60/125,090, filed on March 19, 1999. --

Signed and Sealed this

Twenty-seventh Day of April, 2004

JON W. DUDAS
*Acting Director of the United States Patent and Trademark Office*